US006843555B2

(12) United States Patent
Shrivastava et al.

(10) Patent No.: US 6,843,555 B2
(45) Date of Patent: Jan. 18, 2005

(54) PRINTING METHOD FOR CONTINUOUS INK JET PRINTER

(75) Inventors: Dilip K. Shrivastava, Lake Zurich, IL (US); Henry F. George, Elk Grove Village, IL (US); Andrew E. Fickling, Mt. Prospect, IL (US)

(73) Assignee: Videojet Technologies Inc., Wood Dale, IL (US)

( * ) Notice: Subject to any disclaimer, the term of this patent is extended or adjusted under 35 U.S.C. 154(b) by 388 days.

(21) Appl. No.: 10/012,889

(22) Filed: Oct. 22, 2001

(65) Prior Publication Data

US 2003/0076387 A1 Apr. 24, 2003

(51) Int. Cl.[7] ..... B41J 2/12
(52) U.S. Cl. ..... 347/79
(58) Field of Search ..... 347/79, 77, 73–76, 347/78, 80, 82, 53

(56) References Cited

U.S. PATENT DOCUMENTS

| | | | | |
|---|---|---|---|---|
| 3,298,030 A | | 1/1967 | Lewis et al. | |
| 3,828,354 A | | 8/1974 | Hilton | 347/79 |
| 3,992,712 A | * | 11/1976 | Dill et al. | 347/53 |
| 4,115,787 A | | 9/1978 | Fujimoto et al. | |
| 4,198,642 A | | 4/1980 | Gamblin | |
| 4,216,480 A | | 8/1980 | Buehner et al. | |
| 4,303,925 A | * | 12/1981 | Harbour et al. | 347/74 |
| 4,322,732 A | | 3/1982 | Furukawa et al. | |
| 4,395,716 A | * | 7/1983 | Crean et al. | 347/76 |

(List continued on next page.)

FOREIGN PATENT DOCUMENTS

| | | |
|---|---|---|
| EP | 0 551 763 A1 | 7/1993 |
| EP | 0 690 411 A2 | 1/1996 |
| EP | 0 741 041 A2 | 11/1996 |
| WO | WO 93/10977 | 6/1993 |
| WO | WO 97/06009 | 2/1997 |

*Primary Examiner*—K. Feggins
(74) *Attorney, Agent, or Firm*—McAndrews, Held & Malloy, Ltd.

(57) ABSTRACT

An continuous ink jet printer projects a stream of evenly spaced ink drops toward a substrate and controls placement of the ink drops on the substrate by selectively charging the individual ink drops and passing the charged ink drops through an electric field to control placement of said charged ink drops on a substrate. The printer may be used to print either single or multiple lines of print in a single stroke. A stroke consists of a single column from all lines and can have adjacent drops printed in alternating lines to reduce drop interaction. Each line of print in the stroke having N virtual print positions, at least some of which are being divided into pairs of adjacent positions. Each pair of adjacent positions has a first print position and a second print position. The printer includes a controller having a plurality of first and second look-up tables, each of which is associated with a different one of said pairs of adjacent print positions. Each of the look-up tables contains a plurality of charge values which correspond to the charge to be applied to a print drop in one of the first or second print positions, respectively, as a function of the charges of each of a predetermined number of drops that are proximate to the print drop in the drop stream. The adjacent drops may include a predetermined number of history drops that precede the print drop in the stream and a predetermined number of future drops that follow the print drop in the stream. The controller determines the charge to be applied to drops and produces a control signal responsive thereto by (1) retrieving a charge value from one of the first look-up tables if the drop is to be printed in one of the first print positions, or (2) retrieving a charge value from one of the second look-up tables if the drop is to be printed in one of the second print drop positions. A charging tunnel receives the control signal from the controller and charges the drops to the determined charges in response thereto.

27 Claims, 15 Drawing Sheets

U.S. PATENT DOCUMENTS

| | | | | | |
|---|---|---|---|---|---|
| 4,439,775 | A | | 3/1984 | Johnson | |
| 4,472,722 | A | | 9/1984 | Ebi | |
| 4,490,729 | A | * | 12/1984 | Clark et al. | 347/76 |
| 4,491,852 | A | * | 1/1985 | Jinnai | 347/76 |
| 4,525,721 | A | * | 6/1985 | Crean | 347/76 |
| 4,613,871 | A | | 9/1986 | Katerberg | |
| 4,631,557 | A | | 12/1986 | Cooke et al. | |
| 4,670,761 | A | | 6/1987 | Yoshino et al. | |
| 4,688,049 | A | | 8/1987 | Doyle et al. | |
| 4,845,512 | A | | 7/1989 | Arway | |
| 5,390,290 | A | | 2/1995 | Hayashi et al. | |
| 5,499,321 | A | | 3/1996 | Hayashi et al. | |
| 6,109,739 | A | | 8/2000 | Stamer et al. | |
| 6,280,023 | B1 | * | 8/2001 | Ufkes | 347/78 |

* cited by examiner

| | | | | | | | | |
|---|---|---|---|---|---|---|---|---|
| ○ | ○ | $H_3$ | $H_2$ | $H_1$ | $P_1$ | $F_2$ | $F_1$ | |
| ∅ | ∅ | ∅ | ∅ | ∅ | ∅ | ∅ | $1_S$ | |
| ∅ | ∅ | ∅ | ∅ | ∅ | ∅ | $1_S$ | $2_S$ | |
| 0 | 0 | 0 | 0 | 0 | $1_S$ | $2_S$ | $3_S$ | ← Print Stroke Position 1s |
| 0 | 0 | 0 | 0 | $1_S$ | $2_S$ | $3_S$ | $4_S$ | ← Print Stroke Position 2s |
| 0 | 0 | 0 | $1_S$ | $2_S$ | $3_S$ | $4_S$ | $5_S$ | ← Print Stroke Position 3s |
| 0 | 0 | $1_S$ | $2_S$ | $3_S$ | $4_S$ | $5_S$ | $6_S$ | ← Print Stroke Position 4s |
| 0 | 0 | $2_S$ | $3_S$ | $4_S$ | $5_S$ | $6_S$ | $7_S$ | ← Print Stroke Position 5s |
| 0 | 0 | $3_S$ | $4_S$ | $5_S$ | $6_S$ | $7_S$ | $8_S$ | ← Print Stroke Position 6s |
| | | $4_S$ | $5_S$ | $6_S$ | $7_S$ | $8_S$ | $9_S$ | ← Print Stroke Position 7s |
| | | $5_S$ | $6_S$ | $7_S$ | $8_S$ | $9_S$ | $10_S$ | ← Print Stroke Position8s |
| | | $6_S$ | $7_S$ | $8_S$ | $9_S$ | $10_S$ | ∅ | ← Print Stroke Position 9s |
| | | $7_S$ | $8_S$ | $9_S$ | $10_S$ | ∅ | ∅ | ← Print Stroke Position 10s |

FIG. 7

| Drop No. | First (Lower) Position | Second (Upper) Position |
|---|---|---|
| $1_S$ | 8, 8, 8, 8, 79, 8, 81, 8<br>8, 8, 8, 8, 8, 8, 8, 8<br>8, 8, 8, 8, 84, 8, 86, 8<br>8, 8, 8, 8, 8, 8, 8, 8<br>8, 8, 8, 8, 79, 8, 81, 8<br>8, 8, 8, 8, 8, 8, 8, 8<br>8, 8, 8, 8, 84, 8, 85, 8<br>8, 8, 8, 8, 8, 8, 8, 8 | 8, 8, 8, 8, 87, 8, 89, 8<br>8, 8, 8, 8, 8, 8, 8, 8<br>8, 8, 8, 8, 90, 8, 92, 8<br>8, 8, 8, 8, 8, 8, 8, 8<br>8, 8, 8, 8, 88, 8, 90, 8<br>8, 8, 8, 8, 8, 8, 8, 8<br>8, 8, 8, 8, 91, 8, 94, 8<br>8, 8, 8, 8, 8, 8, 8, 8 |
| $2_S$ | 8, 8, 8, 8,172, 172, 8, 8<br>10, 10, 8, 8,179, 179, 8, 8<br>8, 8, 8, 8, 8, 8, 8, 8<br>8, 8, 8, 8, 8, 8, 8, 8<br>8, 8, 8, 8,169, 169, 8, 8<br>10, 10, 8, 8,178, 178, 8, 8<br>8, 8, 8, 8, 8, 8, 8, 8<br>8, 8, 8, 8, 8, 8, 8, 8 | 8, 8, 8, 8,178, 178, 8, 8<br>11, 11, 8, 8,186, 186, 8, 8<br>8, 8, 8, 8, 8, 8, 8, 8<br>8, 8, 8, 8, 8, 8, 8, 8<br>8, 8, 8, 8,182, 182, 8, 8<br>11, 11, 8, 8,190, 189, 8, 8<br>8, 8, 8, 8, 8, 8, 8, 8<br>8, 8, 8, 8, 8, 8, 8, 8 |
| $3_S$ | 8, 8, 8, 8, 94, 8, 96, 8<br>8, 8, 8, 8, 8, 8, 8, 8<br>8, 8, 8, 8, 97, 8, 99, 8<br>8, 8, 8, 8, 8, 8, 8, 8<br>8, 8, 8, 8, 96, 8, 98, 8<br>8, 8, 8, 8, 8, 8, 8, 8<br>8, 8, 8, 8, 99, 8,102, 8<br>8, 8, 8, 8, 8, 8, 8, 8 | 8, 8, 8, 8,102, 8,104, 8<br>8, 8, 8, 8, 8, 8, 8, 8<br>8, 8, 8, 8,105, 8,107, 8<br>8, 8, 8, 8, 8, 8, 8, 8<br>8, 8, 8, 8,104, 8,106, 8<br>8, 8, 8, 8, 8, 8, 8, 8<br>8, 8, 8, 8,107, 8,110, 8<br>8, 8, 8, 8, 8, 8, 8, 8 |
| | | |
| $9_S$ | 8, 8, 8, 8,136, 8,139, 8<br>8, 8, 8, 8, 8, 8, 8, 8<br>8, 8, 8, 8,139, 8,142, 8<br>8, 8, 8, 8, 8, 8, 8, 8<br>8, 8, 8, 8,139, 8,142, 8<br>8, 8, 8, 8, 8, 8, 8, 8<br>8, 8, 8, 8,143, 8,148, 8<br>8, 8, 8, 8, 8, 8, 8, 8 | 8, 8, 8, 8,136, 8,139, 8<br>8, 8, 8, 8, 8, 8, 8, 8<br>8, 8, 8, 8,139, 8,142, 8<br>8, 8, 8, 8, 8, 8, 8, 8<br>8, 8, 8, 8,139, 8,142, 8<br>8, 8, 8, 8, 8, 8, 8, 8<br>8, 8, 8, 8,143, 8,148, 8<br>8, 8, 8, 8, 8, 8, 8, 8 |
| $10_S$ | 8, 8, 8, 8,223, 223, 8, 8<br>17, 17, 8, 8,237, 237, 8, 8<br>8, 8, 8, 8, 8, 8, 8, 8<br>8, 8, 8, 8, 8, 8, 8, 8<br>8, 8, 8, 8,227, 225, 8, 8<br>17, 17, 8, 8,239, 239, 8, 8<br>8, 8, 8, 8, 8, 8, 8, 8<br>8, 8, 8, 8, 8, 8, 8, 8 | 8, 8, 8, 8,223, 223, 8, 8<br>17, 17, 8, 8,237, 237, 8, 8<br>8, 8, 8, 8, 8, 8, 8, 8<br>8, 8, 8, 8, 8, 8, 8, 8<br>8, 8, 8, 8,227, 225, 8, 8<br>17, 17, 8, 8,239, 239, 8, 8<br>8, 8, 8, 8, 8, 8, 8, 8<br>8, 8, 8, 8, 8, 8, 8, 8 |

FIG. 8A

| | | | | | | | |
|---|---|---|---|---|---|---|---|
| 0 | 1 | 2 | 3 | 4 | 5 | 6 | 7 |
| 8 | 9 | 10 | 11 | 12 | 13 | 14 | 15 |
| 16 | 17 | 18 | 19 | 20 | 21 | 22 | 23 |
| 24 | 25 | 26 | 27 | 28 | 29 | 30 | 31 |
| 32 | 33 | 34 | 35 | 36 | 37 | 38 | 39 |
| 40 | 41 | 42 | 43 | 44 | 45 | 46 | 47 |
| 48 | 49 | 50 | 51 | 52 | 53 | 54 | 55 |
| 56 | 57 | 58 | 59 | 60 | 61 | 62 | 63 |

FIG. 8B

| Drop No. | First (Lower) Position | | | | | | | | Second (Upper) Position | | | | | | | |
|---|---|---|---|---|---|---|---|---|---|---|---|---|---|---|---|---|
| $1_S$ | 8, | 8, | 8, | 8, | 79, | 8, | 81, | 8 | 8, | 8, | 8, | 8, | 87, | 8, | 89, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 84, | 8, | 86, | 8 | 8, | 8, | 8, | 8, | 90, | 8, | 92, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 79, | 8, | 81, | 8 | 8, | 8, | 8, | 8, | 88, | 8, | 90, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 84, | 8, | 85, | 8 | 8, | 8, | 8, | 8, | 91, | 8, | 94, | 8 |
| | 8, | 8, | 8, | 8, | 8, | 8, | 8, | 8 | 8, | 8, | 8, | 8, | 8, | 8, | 8, | 8 |
| $2_S$ | 8, | 8, | 8, | 8, | 172, | 172, | 8, | 8 | 8, | 8, | 8, | 8, | 178, | 178, | 8, | 8 |
| | 10, | 10, | 8, | 8, | 179, | 179, | 8, | 8 | 11, | 11, | 8, | 8, | 186, | 186, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 169, | 169, | 8, | 8 | 8, | 8, | 8, | 8, | 182, | 182, | 8, | 8 |
| | 10, | 10, | 8, | 8, | 178, | 178, | 8, | 8 | 11, | 11, | 8, | 8, | 190, | 189, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |
| $3_S$ (Guard) | 8, | 8, | 8, | 8, | 8, | 8, | 8, | 8 | 8, | 8, | 8, | 8, | 8, | 8, | 8, | 8 |
| | 21, | 21, | 21, | 21, | 8, | 8, | 8, | 8 | 22, | 22, | 22, | 22, | 8, | 8, | 8, | 8 |
| | 8, | 8, | 8, | 8, | 8, | 8, | 8, | 8 | 8, | 8, | 8, | 8, | 8, | 8, | 8, | 8 |
| | 22, | 22, | 22, | 22, | 8, | 8, | 8, | 8 | 23, | 23, | 23, | 23, | 8, | 8, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |
| $13_S$ | 8, | 8, | 8, | 8, | 136, | 8, | 139, | 8 | 8, | 8, | 8, | 8, | 136, | 8, | 139, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 139, | 8, | 142, | 8 | 8, | 8, | 8, | 8, | 139, | 8, | 142, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 139, | 8, | 142, | 8 | 8, | 8, | 8, | 8, | 139, | 8, | 142, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 143, | 8, | 148, | 8 | 8, | 8, | 8, | 8, | 143, | 8, | 148, | 8 |
| | 8, | 8, | 8, | 8, | 8, | 8, | 8, | 8 | 8, | 8, | 8, | 8, | 8, | 8, | 8, | 8 |
| $14_S$ | 8, | 8, | 8, | 8, | 223, | 223, | 8, | 8 | 8, | 8, | 8, | 8, | 223, | 223, | 8, | 8 |
| | 17, | 17, | 8, | 8, | 237, | 237, | 8, | 8 | 17, | 17, | 8, | 8, | 237, | 237, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 227, | 225, | 8, | 8 | 8, | 8, | 8, | 8, | 227, | 225, | 8, | 8 |
| | 17, | 17, | 8, | 8, | 239, | 239, | 8, | 8 | 17, | 17, | 8, | 8, | 239, | 239, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |
| $15_S$ (Guard) | 8, | 8, | 8, | 8, | 8, | 8, | 8, | 8 | 8, | 8, | 8, | 8, | 8, | 8, | 8, | 8 |
| | 27, | 27, | 27, | 28, | 8, | 8, | 8, | 8 | 27, | 27, | 27, | 28, | 8, | 8, | 8, | 8 |
| | 8, | 8, | 8, | 8, | 8, | 8, | 8, | 8 | 8, | 8, | 8, | 8, | 8, | 8, | 8, | 8 |
| | 29, | 29, | 29, | 29, | 8, | 8, | 8, | 8 | 29, | 29, | 29, | 29, | 8, | 8, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |
| | 8, | 8, | 8, | 8, | 8, | 8, | 8, | 8 | 8, | 8, | 8, | 8, | 8, | 8, | 8, | 8 |

FIG. 12

PRINTING METHOD FOR CONTINUOUS INK JET PRINTER

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to ink jet printing, and in particular to an improved method for positioning dots produced by a continuous ink jet printer.

Continuous ink jet printers are well known in the field of industrial coding and marking, and are widely used for printing information, such as expiry dates, on various types of substrate passing the printer on production lines. As shown in FIG. 1, a jet of ink is broken up into a regular stream of uniform ink drops by an oscillating piezoelectric element. The drops then pass a charging plate, which charges individual drops at a selected voltage. The drops then pass through a transverse electric field provided across a pair of deflection plates. Each drop is deflected by an amount which depends on its charge. If the drop is uncharged, it will pass through the deflection plates without deflection. Uncharged and slightly charged drops are collected in a catcher and returned to the ink supply for reuse. A drop following a trajectory that misses the catcher will impinge on the substrate at a point determined by the charge on the drop. Often, each charged drop is interspersed by a guard drop with substantially no charge to decrease electrostatic and aerodynamic interaction between charged drops. As the substrate is moving past the printer, the placement of the drop on the substrate in the direction of motion of the substrate will have a component determined by the time at which the drop is released. The direction of motion of the substrate will hereinafter be referred to as the horizontal direction, and the direction perpendicular to this, in the plane of the substrate will hereinafter be referred to as the vertical direction. These directions are unrelated to the orientation of the substrate and printer in space. If the drops are deflected vertically, the placement of a drop in the vertical and horizontal direction is determined both by the charge on the drop and the position of the substrate.

It is general practice to provide predefined raster patterns, with the matrix for each pattern, customarily representing a character, of a predetermined size. For example, a 5 high by 5 wide matrix representing an image, as shown in FIG. 2A, can be created which represents a whole image such as a character or a portion of an image. A technique which has become widely used for printing these characters or portions of images is disclosed in U.S. Pat. No. 3,298,030 (Lewis et al). A stroke is defined for each column of the matrix and represents a slice of the image. Each usable drop is assigned to each pixel (dot position) in the stroke. If the pixel is a blank pixel, then the drop is not charged and is captured by the catcher to be sent back to the ink supply. If the pixel is to be printed, an appropriate charge is put on the drop so that it is deflected to follow a trajectory that intercepts the substrate at the appropriate position in the column for that stroke. This cycle repeats for all strokes in a character and then starts again for the next character. If the drops are deflected transversely to the direction of travel of the substrate, a set of drops forming a stroke will clearly lie along a diagonal line, as the substrate will move a certain distance between each drop in the stroke. The angular deviation of the line from vertical will increase with the speed of the substrate relative to the drop emission rate. This angular deviation can be counteracted by angling the deflection plates away from the vertical direction by an amount dependent on the expected speed of the substrate. If drops in a stroke are not sequentially allocated to equally spaced positions on the substrate, the points will no longer lie along a straight line. In order to maintain a simple matrix raster pattern, with straight lines in any direction in the matrix mapping onto straight lines on the substrate, it is necessary to print drops in a stroke sequentially with an equal time interval between each stroke. A stroke takes the same time whether it contains one printed drop or five printed drops. Generally, a varying number of extra guard drops are used at the end of each stroke to permit variation in the substrate speed on a stroke by stroke basis.

It is well known that character definition improves with more dot positions in a vertical stroke and more strokes per character. FIGS. 2A and 2B respectively show characters based on 5×5 and 7×9 matrices. The 7×9 matrix clearly yields better defined characters. However, for a constant drop rate determined by the limitations of the hardware, in order to be able to print at all pixel locations in the matrix, the maximum substrate speed will have to be inversely proportional to the number of pixels per character. Traditionally, improved character definition required reducing the maximum substrate speed. Conversely, a smaller matrix allows increased line speed, but the characters become less defined. There is a conflicting need for better defined fonts at higher speeds, which are still formed from a simple orthogonal matrix.

An approach which has been used to improve character definition while maintaining the same stroke rate is described in U.S. Pat. No. 4,115,787 (Fujimoto et al.). While dots are generally printed along a conventional stroke, each dot can optionally be vertically deflected to a different location approximately half a stroke height away. At this time, the print head will have moved approximately half a stroke width in the direction of travel of the substrate relative to a dot on the previous stroke at the same vertical position. This therefore gives a way of printing dots along a "virtual" stroke horizontally between two successive conventional strokes. A significant disadvantage of this technique is that varying the number of guard drops between strokes will have a significant effect on the continuity of the dots in an interpolated stroke. A further disadvantage of this technique is that it is very difficult to establish allowable dot patterns in a font, as there are two allowable dot positions for any particular drop which are substantially separated on the grid of allowable dot positions.

U.S. Pat. No. 6,109,739 (Stamer et al.), owned by the assignee of the present application, discloses another approach for improving character definition while maintaining line speed. The '739 patent provides a print method in which a set number of virtual drop positions (N) are assigned to a stroke, but in which the number of drops that can be printed (n) is less than the number of positions on the stroke. One example disclosed in the '739 patent is a 5×9 font, wherein each stroke has 9 virtual positions, but no more than 5 drops can be printed in a stroke. As can be seen in FIG. 3, the print method of the '739 patent provides improved resolution at the same print speed (e.g., compare FIG. 3 to FIG. 2A).

However, applying the print method of the '739 patent to multiple line text, such as a twin line print application, or to large fonts, such as 16 high or 24 high fonts, has practical limitations. As is discussed in greater detail in the '739 patent (the disclosure of which is hereby incorporated by reference), each drop in the ink jet stream interacts with the other drops in a complex fashion. In particular, any two charged drops have an electrostatic force given by the well-known relation:

$$F \propto \frac{q1 \times q2}{r^2} \quad (1)$$

where q1 and q2 are the electrostatic charges on the two drops, r is the distance between the centers of the two drops and F is the electrostatic force between drops referred to as "drop interaction." This interaction is further complicated by the aerodynamic effects caused by air disturbance due to drops preceding the print drop. Hence, as discussed in the '739 patent, the voltage applied to a print drop is typically compensated for electrostatic and aerodynamic effects based on its interaction with the other drops in the respective stroke. These compensations, which must generally be empirically determined, are time consuming and labor intensive to perform. In a single line application of a small to medium font these compensations are practical to perform and execute during operation. For example, a stroke according to the '739 patent which has 9 virtual print positions only results in $2^9$ (or 512) possible drop combinations. However, it is not feasible or practical to compensate, test, and store all of the possible drop combinations that result when the '739 method is applied to multiple line applications or to large fonts. For example, a twin line application with 9 virtual positions per line results in $2^{18}$ (or 262,144) possible drop combinations for which the voltage compensations are needed. These $2^{18}$ possible combinations may in turn require over 2.6 million bytes of processor memory, e.g. 264,144 possible strokes of 10 drops each. This greatly exceeds the memory capacity of the processors typically employed in continuous ink jet printers, particularly where cost is a limiting factor in the design of the printer.

BRIEF SUMMARY OF THE INVENTION

According to one aspect of the present invention, a method is provided for printing using a continuous ink jet printer of the type which projects a stream of evenly spaced ink drops toward a substrate and controls placement of the ink drops on the substrate by selectively charging the individual ink drops and passing the charged ink drops through an electric field to control placement of said charged ink drops on a substrate. The method includes generating a raster pattern comprising at least one column having N virtual, e.g., potential, print positions therein of which only n of said positions are allowed to be used as active, e.g., actual, print positions in the column, where N>n. Put another each column has N potential print positions, but, in a given stroke, drops can only be printed in a subset n of the N potential print positions. As a result, a matrix of height N is provided, while allowing print speeds associated with a matrix of height n. At least some of the N virtual print positions are divided into pairs of adjacent print positions, wherein each pair of adjacent positions includes a first print position and a second print position. The charge to be applied to a drop is determined as a function of the charges of a predetermined number of drops that are proximate to the print drop in the drop in the stream and whether the print drop is to be printed in the first print position or the second print position of a given pair of adjacent print position. The proximate drops may include a predetermined number of history drops that precede the print drop in the drop stream and a predetermined number of future drops that follow the drop in the drop stream.

The method may print multiple lines of print in a single stroke, wherein each line of print in the stroke includes N virtual print positions therein of which only n of the positions are allowed to be used as active print positions in the print line, where N>n. The combined number of history drops and future drops used to determine the voltage applied to a drop is less than the number of virtual positions in the stroke, and, when the stroke includes multiple lines of print, may be less than the number of virtual print positions in each line of print. According to one specific embodiment, the charge to be applied to a drop is determined as a function of a data window based on the charges of each of 3 history drops and each of 2 future drops.

An ascending ramp sequence may be used to print multiple lines in a single stroke, wherein drops are printed from alternating print lines in the stroke and from lowest charge potential to highest charge potential within the individual lines of print.

A line of guard drops may be provided, wherein the guard drops are uncharged or are charged to a low voltage potential such that they are directed to the ink catcher.

According to one aspect of the invention, the method may include providing first and second look-up tables for each pair of adjacent print positions. Each look-up table includes a plurality of charge values which correspond to the charge to be applied to a print drop as a function of the charges of a predetermined number of history drops that precede the drop in the stream and the charges of a predetermined number of future drops that follow the print drop in the stream. The charge to be applied to a drop is determined by (1) retrieving a charge value from one of the first look-up tables if the print drop is to be printed in one of the first print positions or (2) retrieving a charge value from one of the second look-up tables if the drop is to be printed in one of the second print drop positions.

According to another aspect of the present invention, a continuous ink jet printer projects a stream of evenly spaced ink drops toward a substrate and controls placement of the ink drops on the substrate by selectively charging the individual ink drops and passing the charged ink drops through an electric field to control placement of the charged ink drops on a substrate. The printer includes means for generating a raster pattern comprising at least one column having a plurality of virtual print positions therein. At least some of said virtual print positions are divided into pairs of adjacent print positions, wherein each pair of adjacent print positions has a first print position and a second print position. The printer includes means for determining a charge to be applied to the drops in the stream as a function of the charges of a predetermined number that are proximate to the print drop in the drop stream and whether the drop is to be printed in the first or second print position of a given pair. The printer also includes means for charging the drops to the determined charges. The proximate drops may include a predetermined number of history drops that precede the drop in the stream and/or a predetermined number of future drops that follow the print drop in the stream.

The means for generating the raster pattern and the means for determining the drop charges is preferably implemented in a controller, such as a general purpose processor, microprocessor, microcontroller, or embedded controller, which operates under general program control of instructions stored in associated memory. According to one aspect, the memory stores a plurality of first look-up tables and second look-up tables, each of which is associated with a different one of the pairs of adjacent print positions. Each of the first look-up tables contains a plurality of charge values which correspond to the charge to be applied to a print drop in one of the first print positions as a function of (1) the charges of a predetermined number of history drops that precede the drop in the stream and (2) the charges of a predetermined number of future drops that follow the print drop in the stream. Each of the second look-up tables contains a plurality of charge values which correspond to the charge to be applied to a print drop in one of the second print positions as a function of (1) the charges of a predetermined number of history drops that precede the drop in the stream and (2) the charges of a predetermined number of future drops that follow the print drop in the stream.

The controller is adapted to determine the charge to be applied to drops in the stream and produce a control signal responsive thereto. The controller determines the charge for a drop by (1) retrieving a charge value from one of the first look-up tables if the drop is to be printed in one of the first print positions, or (2) retrieving a charge value from one of the second look-up tables if the drop is to be printed in one of the second print positions. A means for charging the drops may include a charging tunnel which is adapted to receive the control signal from the controller and charge the drops to the determined charges in response thereto.

BRIEF DESCRIPTION OF SEVERAL VIEWS OF THE DRAWINGS

FIG. 7 illustrates the manner in which the accumulator operates when a stroke is printed in accordance with the specific embodiment of FIGS. 5 and 6A–6E.

FIG. 8A illustrates a manner for storing the compensated charge values for drops printed in accordance with the specific embodiment of FIGS. 5 and 6A-6E.

FIG. 8B further illustrates the manner in which the look-up tables of FIG. 8A are indexed by the accumulator.

FIG. 12 is a table illustrating a way of storing the compensated charge values for drops printed in accordance with the specific embodiment of FIG. 11.

Figure 1:
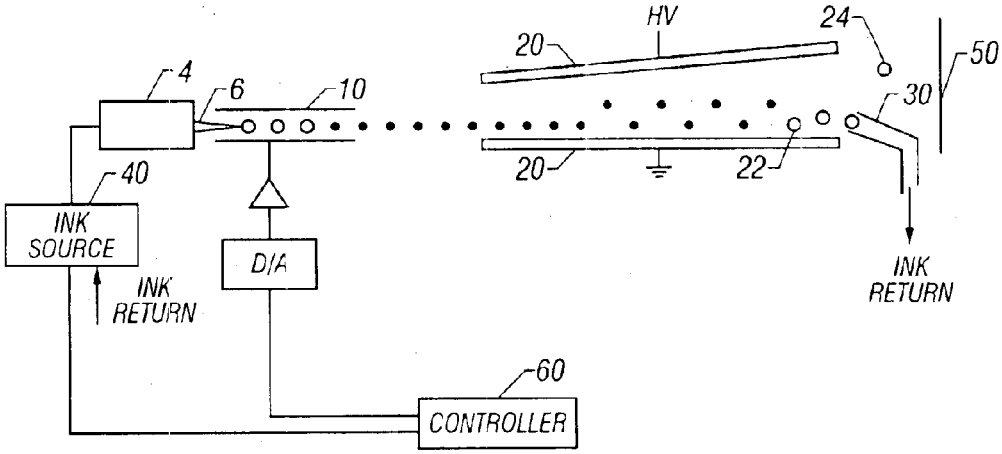
FIG. 1 shows the operation of a typical continuous ink jet printer.
Figure 2A:
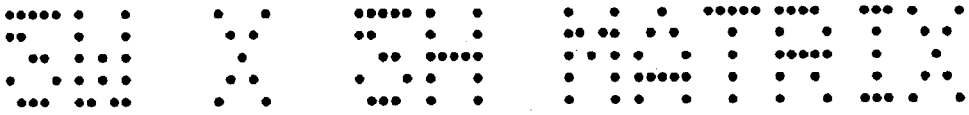
FIG. 2A illustrates characters from a typical 5×5 font used by continuous ink jet printers.
Figure 2B:
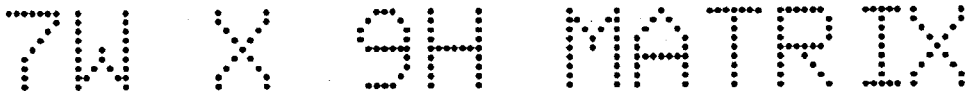
FIG. 2B illustrates characters from a standard 7×9 font used by known continuous ink jet printers.
Figure 3:
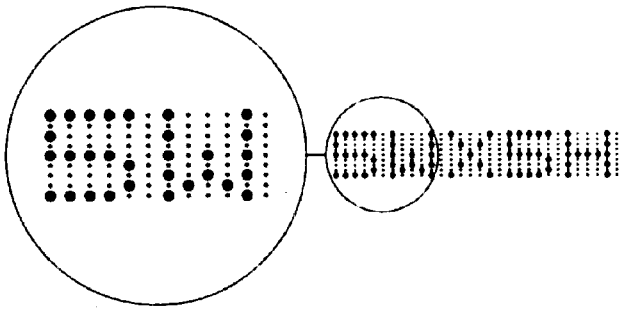
FIG. 3 illustrates characters from a 5×9 font generated using the method of the '739 patent, wherein each vertical stroke has 9 virtual positions, but no more than 5 drops can be printed in a stroke.

The foregoing summary, as well as the following detailed description of the preferred embodiments of the present invention, will be better understood when read in conjunction with the appended drawings. For the purpose of illustrating the preferred embodiments of the present invention, there is shown in the drawings, embodiments which are presently preferred. It should be understood, however, that the present invention is not limited to the arrangements and instrumentality shown in the attached drawings.

DETAILED DESCRIPTION OF THE INVENTION

According to a specific embodiment of the present invention shown in FIG. 1, a continuous ink jet printer 1 includes a print head with a drop generator 4 which receives ink from an ink source 40. The drop generator incorporates a piezoelectric oscillator which creates perturbations in the ink flow at a nozzle 6. Regular sized and spaced drops are accordingly emitted from the nozzle. The drops pass through a charging tunnel 10, where a different charge can be applied to each drop. This charge determines the degree of deflection as the drop passes between a pair of deflection plates 20 between which a substantially constant electric field is maintained. Uncharged or slightly charged drops 22 pass substantially undeflected to a catcher 30, and are recycled to ink source 40. Charged drops 24 are projected toward a substrate 50 and are deflected so as to have a trajectory striking the latter which moves past the print head in the horizontal direction. The level of charge applied to the drop controls its vertical displacement/position on the substrate.

The charge to be applied to a drop is determined by a controller 60, which may be implemented by a device such as a general purpose processor, microprocessor, microcontroller, or embedded controller having appropriate input and output circuitry, as is well known in the art. The controller operates under general program control of the instructions stored in an associated memory. The memory generally includes a section of nonvolatile memory (e.g., flash memory, hard disk memory, EEPROM, and the like) and volatile memory (e.g., RAM). The controller is programmed to deliver control signals to the charge tunnel 10 to control the charges applied to the individual drops as they pass through the charge tunnel. One suitable microprocessor is a model DS 80C310 microprocessor as is available from Dallas Semiconductor of Dallas Tex.; however, numerous other commercially available devices could readily be adapted to perform the functions of the controller.

Figure 4:
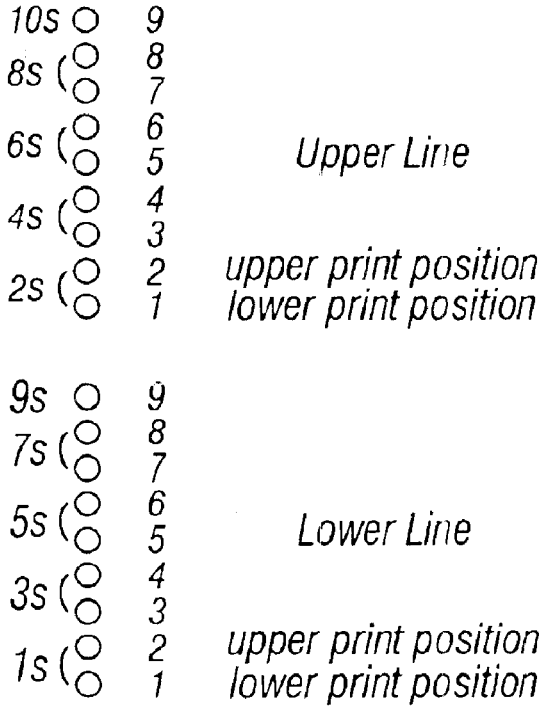
FIG. 4 illustrates a method of printing two lines of print in accordance with a specific embodiment of the present invention.
Figure 5:
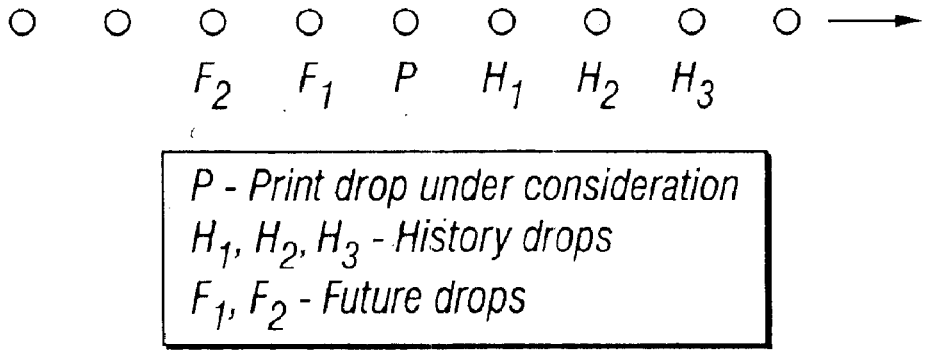
FIG. 5 illustrates a data window that may be used in a specific embodiment of the present invention.
Figure 6A:
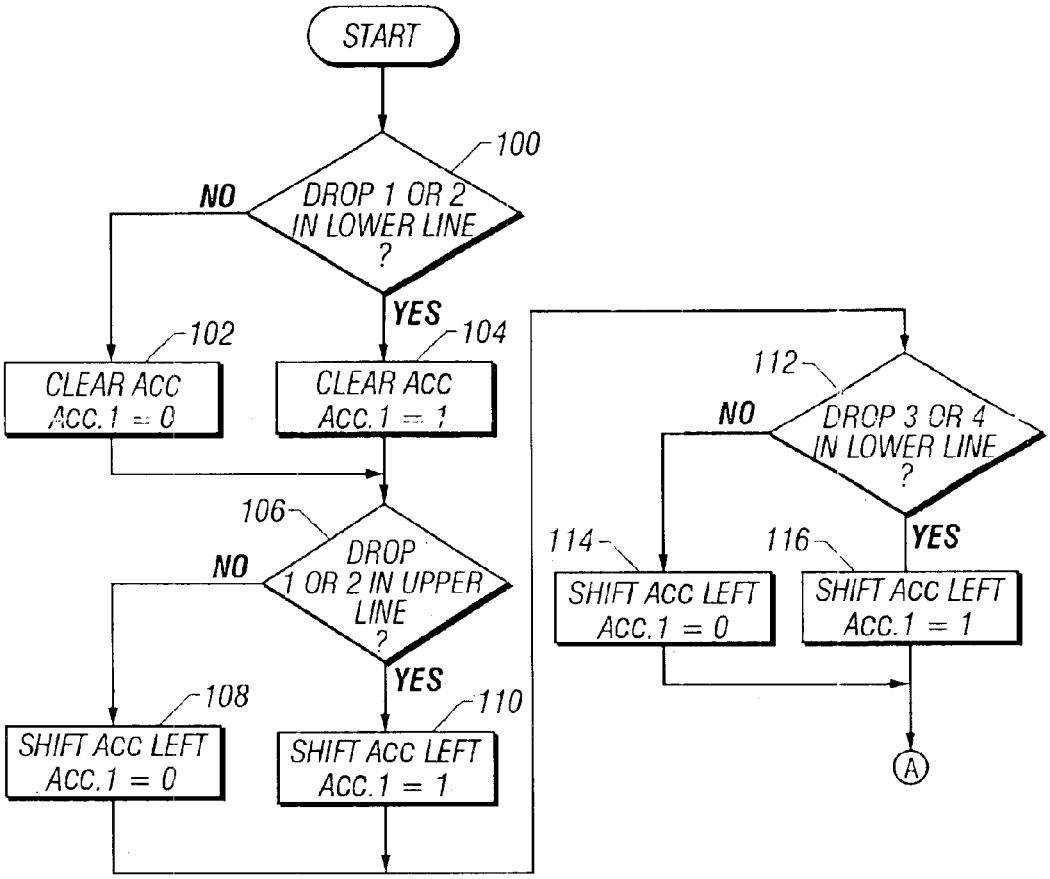
FIGS. 6A–6E are a flowchart showing how printing of a stroke is performed in accordance with a specific embodiment of the present invention.
Figure 6B:
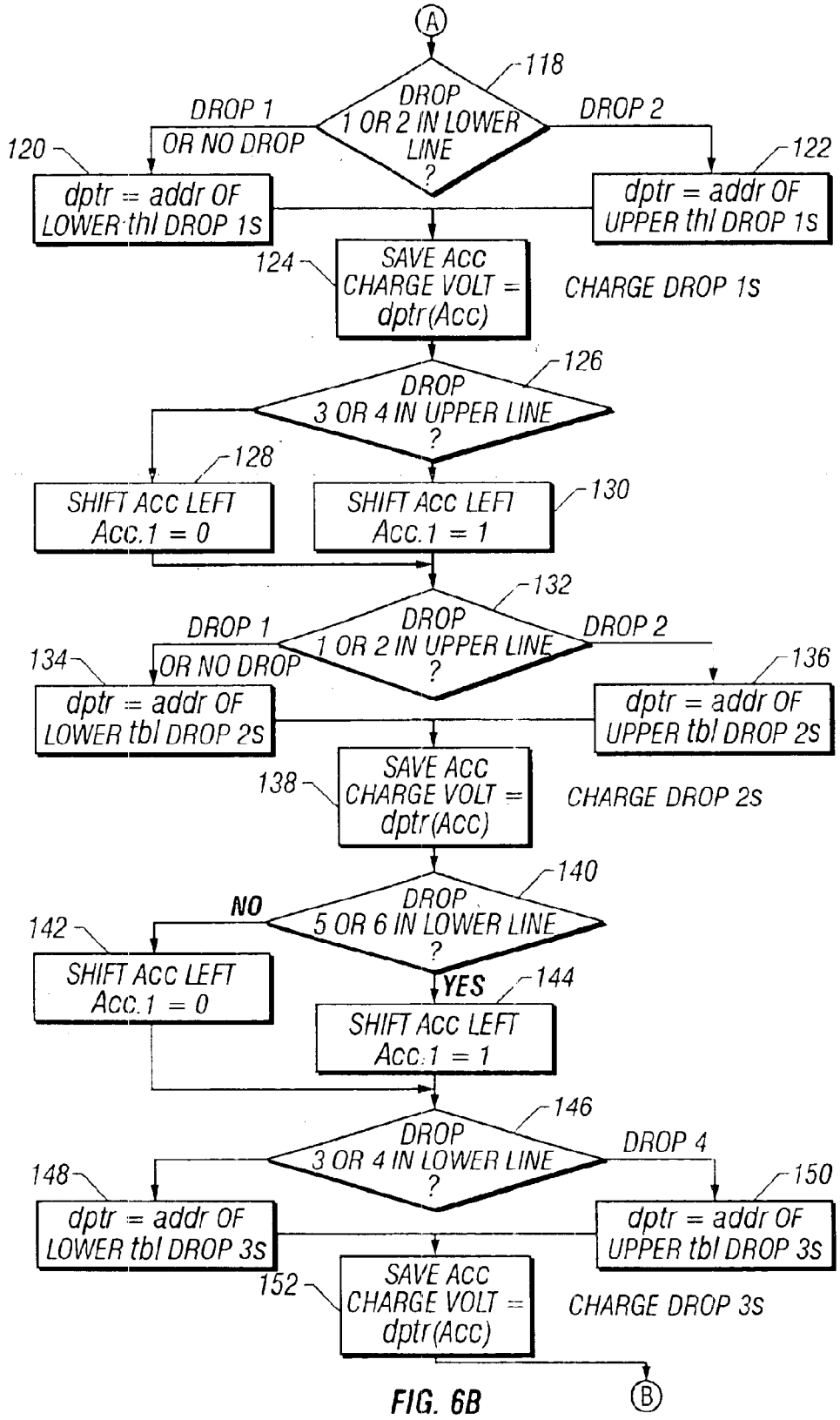
Figure 6C:
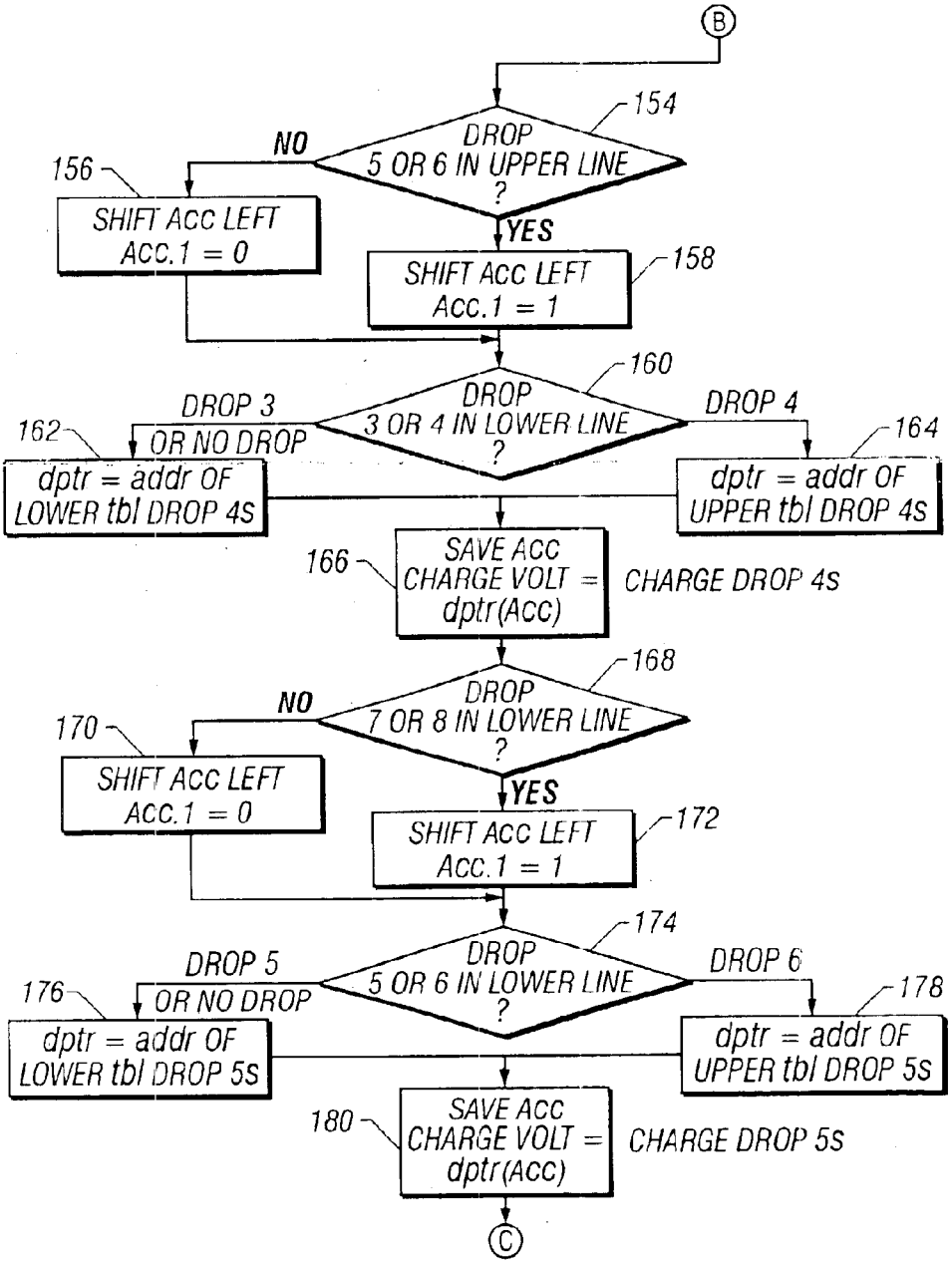
Figure 6D:
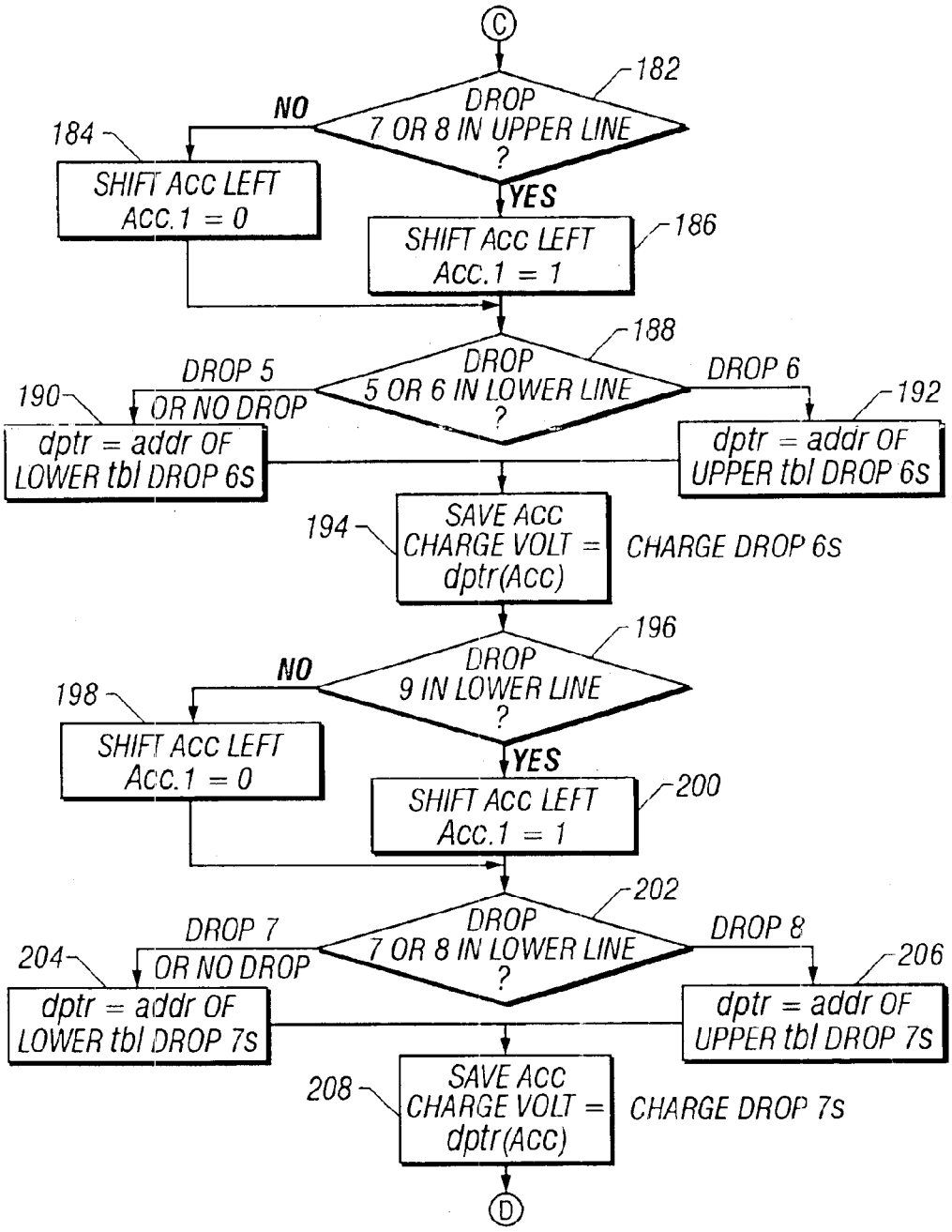
Figure 6E:
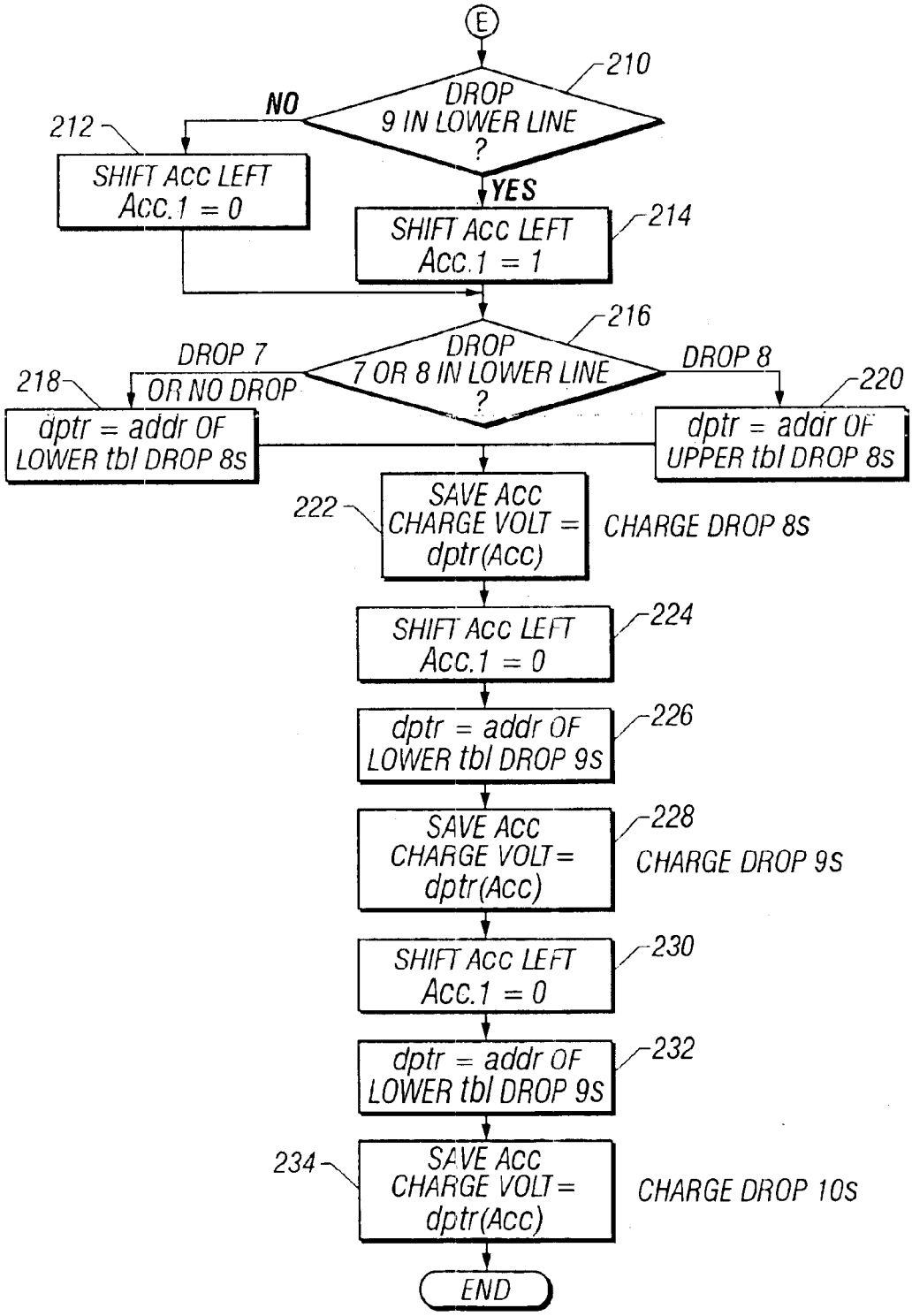

With reference to FIGS. 4 and 5, drops are charged and printed in accordance with a stroke-based method, wherein each stroke or column is divided into N virtual print positions of which only n of said positions are allowed to be used as active print positions in the column, where N>n. When, as shown in FIG. 4, a stroke includes multiple lines of print, each line of print is divided into N virtual print positions, of which only n of the virtual print positions are allowed to be used as active print positions in the print line, where N>n. In the specific embodiment shown in FIG. 4, there are two lines of print, each of which has 9 virtual print positions (N=9), of which only 5 (n=5) of the positions are allowed to be used as active print positions in any given stroke.

At least some of the N virtual print positions are divided into pairs of adjacent print positions, wherein each pair of adjacent positions includes a first (e.g., lower) print position and a second (e.g., upper) print position. In single-line print applications, only one print position per pair, i.e., either the upper or lower print position, is typically used in any given stroke so as to reduce the effect of electrostatic interaction between print drops. When a stroke contains multiple lines of print, the drops may be printed in both positions of a given pair of adjacent print positions by printing the drops in an alternating ascending ramp, as is discussed below. Printing in an alternating ascending ramp reduces the effect of electrostatic interaction between the drops.

Each line of print in the example of FIG. 4 has an odd number (N=9) of virtual print positions. Hence, there are actually eight sets of adjacent pairs (numbered 1*s* to 8*s*) and two unpaired print positions (numbered 9*s* and 10*s*). In the illustrated embodiment, the uppermost print position in each line is unpaired; however, it will be appreciated that this arrangement is merely an exemplary, non-limiting example.

The reference numerals 1*s* to 10*s* are used to designate the print order during a stroke. In the following description, these positions will be referred to as stroke positions, e.g., the "first stroke position 1*s*." As is shown in FIG. 4, the drops may be printed in an alternating ascending ramp sequence (specifically, 1*s* to 10*s*), wherein the drops in a given stroke are printed from alternating print lines in the stroke and from lowest position, i.e., charge potential, to highest position within each line of print. Printing in an alternating ascending ramp sequence increases the vertical distance on the substrate between adjacent drops in the stream, thereby drastically reducing the electrostatic interaction.

As was discussed above, print quality is improved by compensating the charge to be applied to a drop (for electrostatic and aerodynamic effects) based on its interaction with the other drops in the respective stroke. These compensations are time consuming and labor intensive to perform. The '739 patent uses a stroke-by-stroke compensation, where all possible drop combinations are compensated. This is practical for small strokes, e.g., where n=5 or 9 (and, N=9 or 13, respectively). However, as was discussed above, it is not feasible or practical to compensate, test, and store all of the possible drop combinations that result when the '739 method is applied to multiple line applications or to large fonts.

This problem is addressed in the present application by using a data window to greatly reduce the number of such compensation determinations that need to be made while still providing acceptable print quality. The use of windowing in charge compensation determinations is known in the art. For example, windowing has been used in the past to print single lines of relatively large fonts, e.g., 16 high or 24 high using traditional print methods. In such an application, the windowing technique is easy to apply because there are no virtual positions, as is the case with the '739 patent. However, traditional windowing techniques will not work with the method of the '739 patent because the '739 patent uses virtual print positions which may or may not be used during any given stroke.

The data window described in the present application overcomes this problem by determining the charge to be applied to a drop as a function of (1) the charges of each of a predetermined number of history drops that precede the drop in the stream, (2) the charges of each of a predetermined number of future drops that follow the print drop in the stream, and (3) whether the drop is to be printed in the first (lower) print position or the second (upper) print position of a given pair of print positions. The combined number of history drops and future drops used in the data window to determine the voltage applied to a drop may preferably be less than the number of virtual positions in the stroke. And, when the stroke includes multiple lines of print, the combined number of history and future drops may be less than the number of virtual positions in an individual line of print. Moreover, in some applications it may be desirable to use a data window that only looks at drops that precede, or alternatively follow, the print drop in the stroke.

In the illustrated embodiment, the data window is based on 3 history drops and 2 future drops, as is shown generally in FIG. 5. The number of drops in the window is not critical, and, as will be appreciated, fewer or a greater number of print drops can be considered without departing from the scope of the appended claims. However, diminishing returns are achieved as a greater number of drops are considered. In particular, considering the effect of a larger number of drops requires more computer memory and processing time, as well as increasing the lab time required to build the compensation tables. Moreover, the electrostatic effect of drops decreases according to the inverse square law previously discussed above. Hence, the drops closest to the print drop under consideration have the greatest impact, and, at some point, the electrostatic effect of the farther-spaced drops becomes negligible. The example described in the present application is believed to represent a reasonable compromise between the restrictions on determining and processing the compensation voltages and the electrostatic and aerodynamic effects drops surrounding the print drop. Applying a data window of 3 history drops and 2 future drops allows all of the 262,144 possible drop combinations in the illustrated example to be printed using 1152 bytes of memory, as opposed to the 2.6 million bytes that would be required using the method of the '739 patent. Specifically, as is described below, the windowing technique allows a twin line application with 9 virtual positions per line to be implemented with as few as 18 data tables, each of which has 64 bytes for a total of 1152 bytes of memory.

In the illustrated example, the data window includes more history drops than future drops. This is done because the history drops have the most electrostatic effect on the print drop during drop formation. (Note, the future drops do not yet exist when the print drop is being formed).

Referring now to FIGS. 6A–6E, an embodiment of software for programming the controller 60 in accordance with certain aspects of the present invention is explained. The process of writing software code from flowcharts such as these is a mere mechanical step for one skilled in the art. The program depicted in this flowchart is particularly well adapted for use with the DS 80C310 microprocessor described above, although other microprocessors can also be utilized. A software program may be readily coded from this detailed flowchart using the instruction set associated with the DS 80C310 microprocessor, or can be coded with the instructions of any other suitable microprocessor. In this respect, the following nomenclature has been used in the flowchart:

Dptr—refers to the DS 80C310 data pointer register, which is a 16 bit wide address register that points to the look-up table of charge voltages for a given drop Acc—refers to the DS 80C310 accumulator, which is 1 byte (8 bits) long and is used as an index to charge voltage into the look-up table pointed to by DPTR for the current print drop.

Charge voltage=dptr(Acc)—causes the controller 60 to send the charge voltage selected from the look-up table to the charging tunnel 10 to charge the print drop.

Acc.1=0 or 1—sets least significant bit of the accumulator to a 0 or 1.

Referring to the flowchart, in the blocks 100 to 116 the controller 60 initializes the accumulator to prepare to charge a drop to be "printed" in the first stroke position 1*s*. When no drop is to be printed in a given stroke position, e.g., the first stroke position, the software operates such that the corresponding drop in the drop stream is not charged or is charged to a relatively low voltage such that the drop is directed to the catcher. Initially, in block 100, the controller 60 checks to see if a drop is to be printed in either position of the first stroke position 1*s*, i.e., in either the first or second print position of the lower line of print in FIG. 4. If no drop is to be printed in the first stroke position, control is passed to block 102 where the accumulator is cleared. Conversely, if a drop is to be printed in the first stroke position, control is passed to block 104 where the accumulator is initially cleared and then a 1 is moved into its least significant bit.

In this respect, attention is directed to FIG. 7, which shows the status of the accumulator at different stages during execution of the program. As the program is executed, the accumulator is filled from right to left, i.e., from least significant bit to most significant bit to provide a data window for the current print drop. The accumulator provides a binary number, which is used as an index to a look-up table. The look-up table in turn provides the charge voltage to apply to the print drop—compensated based on its history and future drops. In the specific example, the first six bits of the accumulator are used for this function. This provides a data window consisting of three history drops (designated as $H_1$, $H_2$, and $H_3$ in FIGS. 5 and 7) and two future drops (designated as $F_1$ and $F_2$ in FIGS. 5 and 7) for the current print drop (designated as P in FIGS. 5 and 7).

The top row of FIG. 7 represents the status of the accumulator after blocks 100 to 104 have been executed. As can be seen, all of the bits of the accumulator are set to zero except for the least significant bit. The least significant bit is either set to a 0 in block 102 if no drop is to be printed in the first stroke position 1*s*, or to a 1 in block 104 if a drop is to be printed in one of the positions in the first stroke position.

Control is then passed to block 106 to determine if a drop is to be printed in either position in the second stroke position 2*s*, i.e., in either of the first two print positions of the second (upper) line of print. If no drop is to be printed in the second stroke position 2*s*, control is passed to block 108 where the accumulator is shifted left one position and a 0 is moved into its least significant bit. Conversely, if a drop is to be printed in one of the print positions in the second stroke position 2*s*, control is passed to block 110 where the accumulator is shifted left and a 1 is moved into its least significant bit. The second row of FIG. 7 represents the status of the accumulator after blocks 106 to 110 have been executed. As can be seen, the two least significant bits contain bits representing the status of the first and second stroke position 1*s* and 2*s*, while the remaining bits contain zeros.

Control is then passed to the block 112 to determine if a drop is to be printed in either position in the third stroke position 3*s*, i.e., in either the third or fourth print positions in the lower line of print. If no drop is to be printed in the third stroke position 3*s*, control is passed to block 114 where the accumulator is shifted left one position and a 0 is moved into its least significant bit. Conversely, if a drop is to be printed in the third stroke position 3*s*, control is passed to block 116 where the accumulator is shifted left and a 1 is moved into its least significant bit. The third row of FIG. 7 represents the status of the accumulator after blocks 112 to 116 have been executed.

Next, in the blocks 118 to 124, the controller 60 retrieves the charge voltage to be applied to the print drop in the first stroke position 1*s* based on the data window stored in the accumulator. In this respect, the controller 60 memory includes a first (or lower) look-up table and a second (or upper) look-up table for each pair of adjacent print positions. Hence, in the specific example, there are a total of 20 look-up tables, as is generally illustrated in FIG. 8A. Each look-up table includes a plurality (64 in the illustrated example) of charge values which correspond to the charge to be applied to a print drop. These charge values are experimentally determined to compensate for the effects of predetermined history drops (3 in the illustrated example) that precede the print drop in the stream and a predetermined number (2 in the illustrated example) of future drops that follow the print drop in the stream. The charge to be applied to a particular drop is determined by either retrieving a charge value from the appropriate one of the first look-up tables if the print drop is to be printed in the first, e.g., lower, print position of a given stroke position or if no drop is to be printed, or retrieving a charge value from the appropriate one of the second look-up tables if the drop is to be printed in the second, e.g., upper, print drop position.

Hence, in block 118, the controller 60 determines whether a drop is to be printed in the first or second position of the first stroke position 1*s*. Control is passed to block 120 if a drop is to be printed in the first position of the first stroke position 1*s*, i.e., in drop position 1 of the lower line in FIG. 4. Control is also passed to the block 120 if no drop is to be printed in either print position in the first stroke position 1*s*. In block 120 the register DPTR is set to point at the lower look-up table for first stroke position 1*s*. Control is then passed to the block 124, causing the controller 60 to deliver the voltage selected from the first (lower) look-up table to the charging tunnel 10, thereby charging the print drop P to the appropriate voltage. As is shown in FIG. 8B, the storage locations in the data tables are indexed from 0 in the upper left position to the 63 lower right position. Hence, for example, if the accumulator reads 00000110 at step 120, a charge value of 81 volts will be retrieved from position number 6 in the first (lower) look-up table for the first stroke position 1*s*. Conversely, if a drop is to be printed in the upper position in the first stroke position 1*s*, control is passed to block 122 and then to block 124. In block 122, the controller retrieves a voltage from the second (upper) look-up table for the first stroke position 1*s*.

This general sequence of updating the accumulator and retrieving the charge value from memory is repeated in blocks 126 to 222 in order to appropriately charge the drops for the second stroke position 2*s* through the eighth stroke position 8*s*. After the drop for the eighth stroke position 8*s* is charged in step 222, control is passed to block 224 where the accumulator prepares to charge a drop in the ninth stroke position 9*s* by shifting the accumulator to the left and loading a zero into its least significant bit (i.e., in this embodiment, no future drop information for the next stroke is obtained prior to charging the drops in the ninth and tenth stroke positions of the current stroke). Control is then passed to block 226 where the appropriate voltage is retrieved from the voltage table for the ninth stroke position 9*s*. In this respect, FIG. 8A shows both an upper table and a lower table for the ninth stroke position 9*s*, even though there is only one print position in the ninth stroke position. Two tables may be included, as shown, for software convenience. Alternatively, stroke positions, such as the ninth stroke position 9*s*, which only have a single print position could be implemented using a single look-up table.

Control is then passed to block 228, causing the controller 60 to deliver the voltage selected from the look-up table in step 226 to the charging tunnel 10 to charge the print drop to the appropriate voltage. A similar process is repeated in the steps 230 to 234 to charge a drop in the tenth stroke position 10*s*.

Figure 9A:
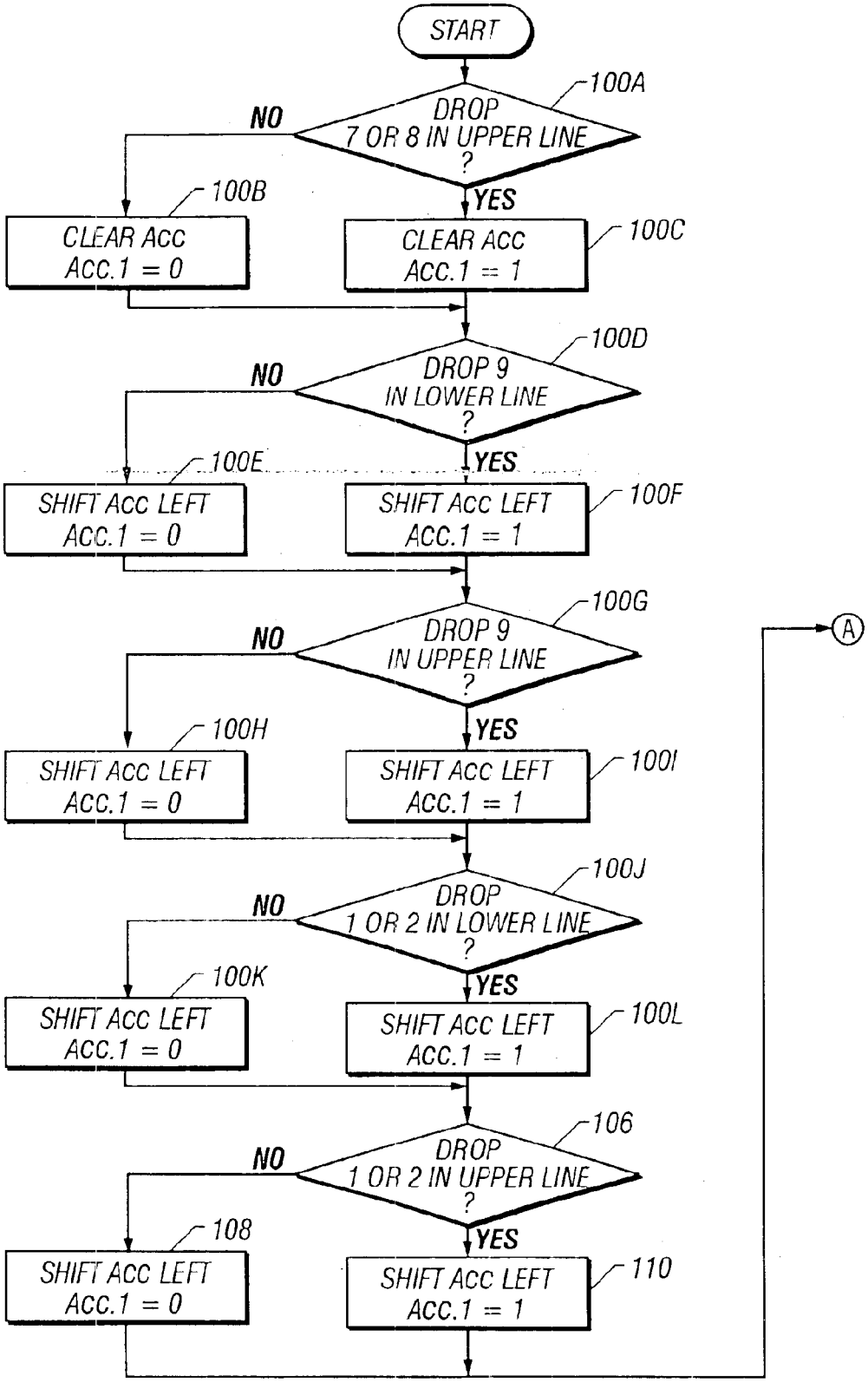
FIG. 9 is a modified flowchart that accounts for the effect of drops from a preceding stroke.
Figure 9B:
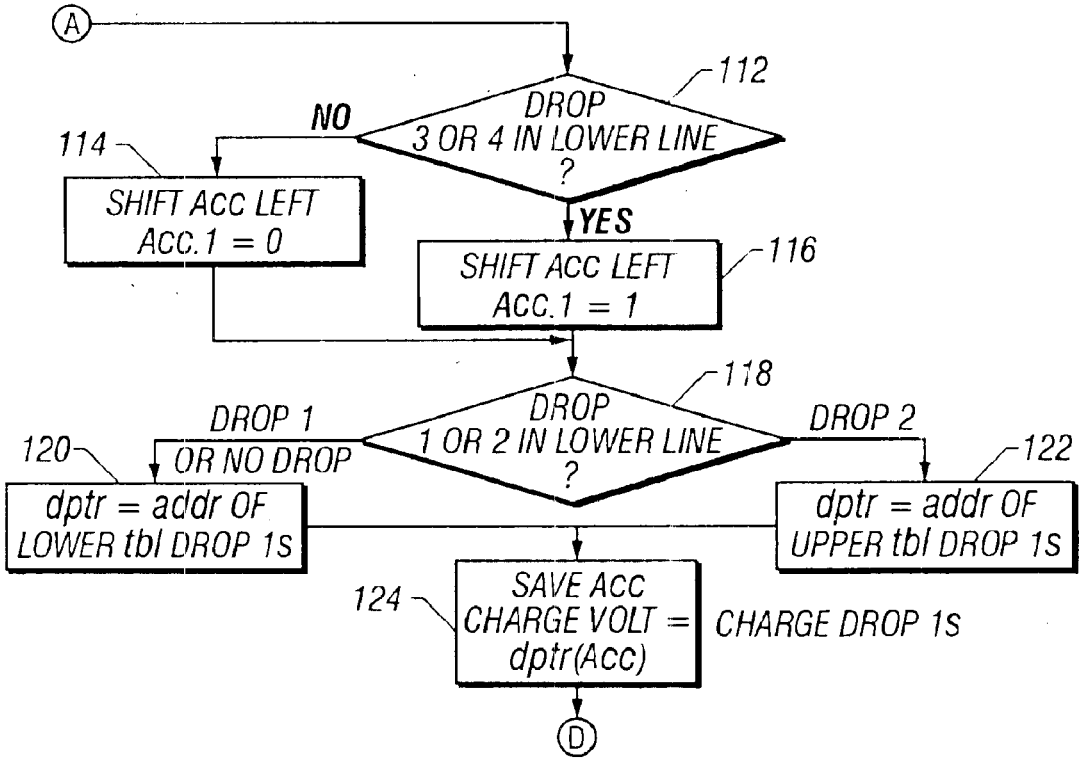

The program illustrated in the flowchart of FIGS. 1–6 does not account for the effect of drops from the previous stroke at the beginning of a stroke. Similarly, at the end of the stroke, it does not account for the effect of the drops in the stroke that will follow the current print stroke. FIG. 9 is a partial modified flowchart, which accounts for the effect of drops from the prior stroke. The flowchart of FIG. 9 is identical to that shown in FIGS. 6A–6E, except that steps 100A–100L are used in place of steps 100–104. In steps 100A through 100I, the accumulator is loaded with information for three history drops from the proceeding stroke. As will be appreciated, these history drops correspond to the stroke positions eight 8*s* through ten 10*s* from the prior stroke. In steps 100J through 100L, the accumulator is loaded with the position of the print drop in first stroke position 1*s* of the current stroke. The remainder of the program executes in the manner described above in connection with FIGS. 6A–6C.

Figure 10:
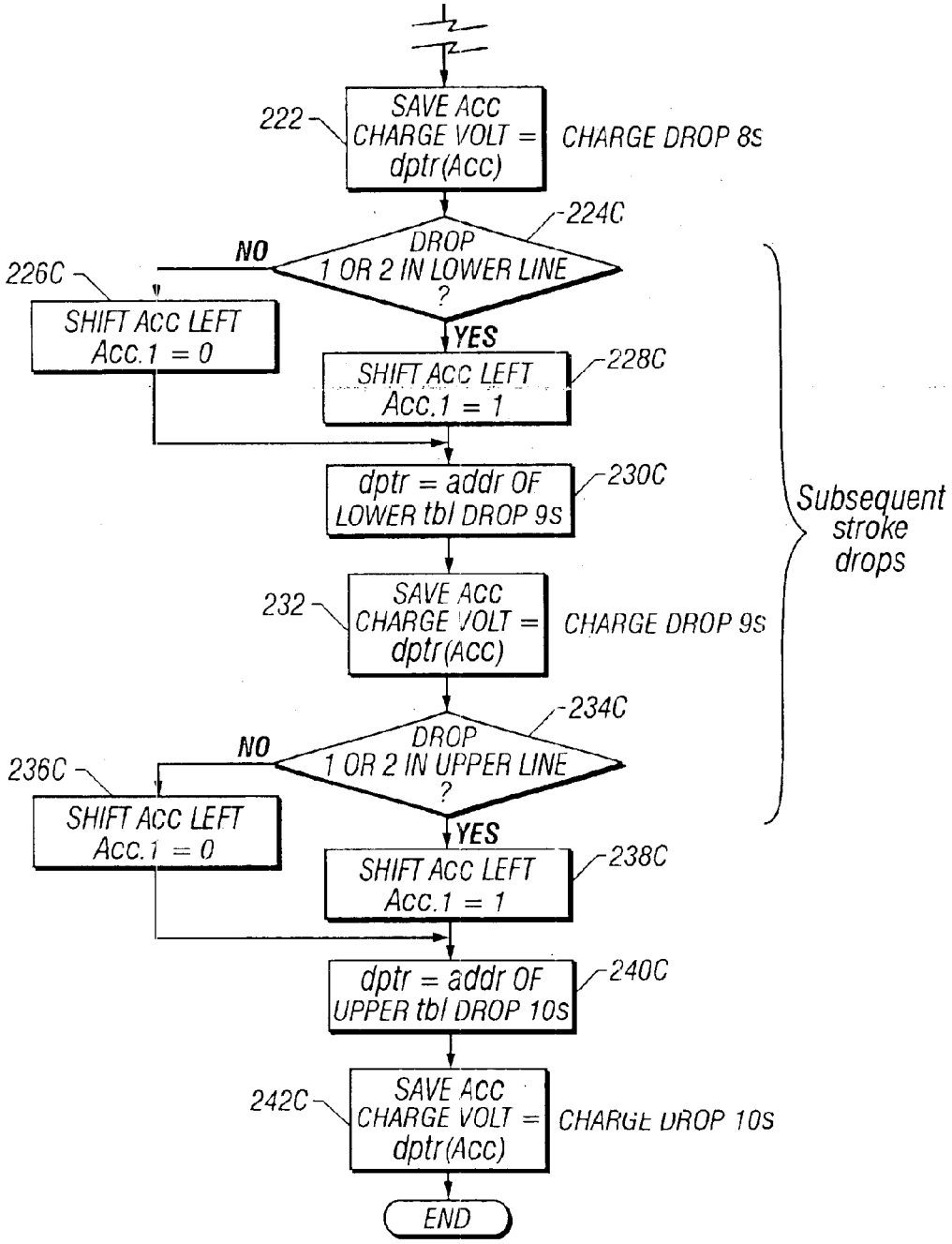
FIG. 10 is a modified flowchart that accounts for the effects of drops from a subsequent stroke.

FIG. 10 is a partial modified flowchart, which accounts for the effects of drops from a subsequent stroke. The flowchart of FIG. 10 is identical to that of FIGS. 6A–6E, except that steps 224C through 242C are used in place of steps 224 through 234. In this respect, steps 224C to 238C are used to update the accumulator with future drop information from the next stroke prior to printing drops in the ninth and tenth stroke positions of the current stroke.

Figure 11:
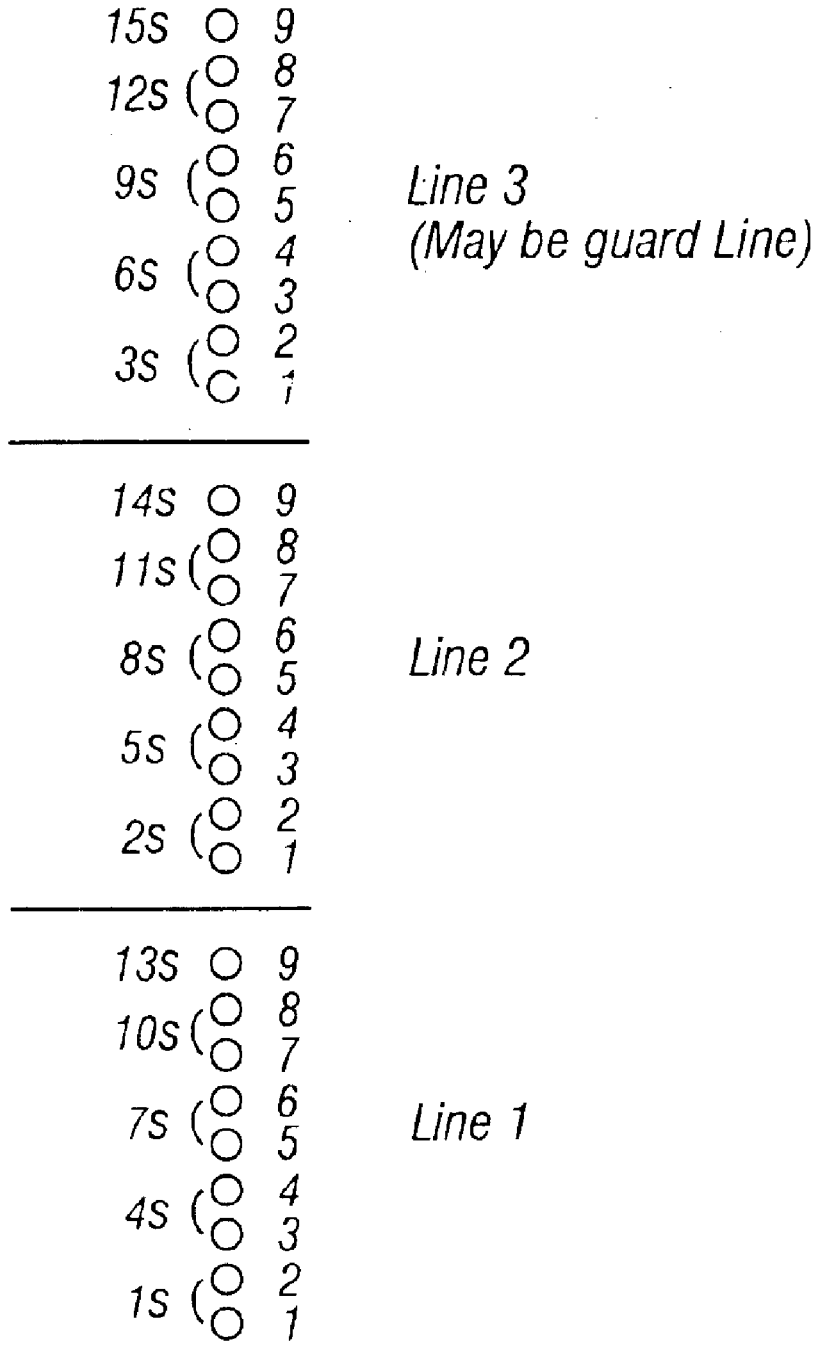
FIG. 11 illustrates a method of printing three lines of print in accordance with a specific embodiment of the present invention, where one line of print may comprise guard drops which are directed to the catcher.

The methodology shown in the above example may readily be expanded to additional lines of print. In this respect, FIG. 11 illustrates a stroke consisting of three lines of print, each having 9 virtual positions of which 5 positions can be used in any given stroke. This results in fifteen stroke positions that are numbered 1*s* to 15*s* in FIG. 11. In some applications it may be desirable to provide guard drops in the stroke to reduce electrostatic interaction between adjacent drops, e.g., drops printed in stroke positions 1*s* and 2*s*. This can be accomplished by providing a "line" of print drops consisting entirely of guard drops, which are uncharged or slightly charged to a relatively low voltages that are insufficient to deflect the drops above the catcher. For example, in FIG. 11 the third print line could be used to provide guard drops. The guard line in FIG. 11 has been divided into pairs of adjacent virtual positions in the same manner as the print lines. It will be appreciated, however, that this step is not necessary for the guard line, but it may be used for software convenience. As is illustrated in FIG. 12, the charge look-up tables for the guard drops consist of relatively low voltages that are insufficient to deflect the drops above the catcher.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A method for printing using a continuous ink jet printer of the type which projects a stream ink drops toward a substrate and controls placement of the ink drops on the substrate by selectively charging the individual ink drops and passing the charged ink drops through an electric field to control placement of said charged ink drops on a substrate, the method comprising:

generating a raster pattern comprising at least one column having N virtual print positions therein of which only n of said positions are allowed to be used as active print positions in the column, where N>n;

dividing at least some of the N virtual print positions into pairs of adjacent print positions, each pair of adjacent print positions having a first print position and a second print position;

determining a charge to be applied to a drop as a function of (1) the charges of each of a predetermined number of drops that are proximate to the drop in the stream, (2) whether the drop is to be printed in one of the first print positions; and (3) whether the drop is to be printed in one of the second print positions; and charging the drops to the determined charges.

2. The method of claim 1, wherein the predetermined number of drops that are proximate to the drop in the stream comprise a plurality of history drops that precede the print in the drop in the drop stream.

3. The method of claim 1, wherein the predetermined number of drops that are proximate to the drop in the stream comprise a plurality of the future drops that follow the print drop in the drop stream.

4. The method of claim 1, wherein the predetermined number of drops that are proximate to the drop in the stream comprises a plurality of drops that precede the print drop in the drop stream and a plurality of future drops that follow the print drop in the drop stream.

5. The method of claim 4, further comprising:

providing a first look-up table of charge values for each pair of adjacent print positions, each of said first look-up tables including a plurality of charge values which correspond to the charge to be applied to a print drop as a function of (1) the charges of each of a predetermined history drops that precede the drop in the stream and (2) the charges of each of a predetermined number of future drops that follow the print drop in the stream;

providing a second look-up table of charge values for each pair of adjacent positions, each of said second look-up tables including a plurality of charge values which correspond to the charge to be applied to a print drop as a function of (1) the charges of each of a predetermined history drops that precede the drop in the stream and (2) the charges of each of a predetermined number of future drops that follow the print drop in the stream; and wherein the determining step further comprises determining whether a drop is to be printed in one of the first and second print positions and (1) retrieving a charge value from the first look-up table if the print drop is to be printed in the first print position and (2) retrieving a charge value from the second look-up table if the print is to be printed in the second print drop position.

6. A method for printing using a continuous ink jet printer of the type which projects a stream ink drops toward a substrate and controls placement of the ink drops on the substrate by selectively charging the individual ink drops and passing the charged ink drops through an electric field to control placement of said charged ink drops on a substrate, the method comprising:

generating a raster pattern comprising at least one column having N virtual print positions therein of which only n of said positions are allowed to be used as active print positions in the column, where N>n;

dividing at least some of the N virtual print positions into pairs of adjacent print positions, each pair of adjacent print positions having a first print position and a second print position;

determining a charge to be applied to a drop as a function of (1) the charges of each of a predetermined number of history drops that precede the drop in the stream, (2) the charges of each of a predetermined number of future drops that follow the print drop in the stream, (3) whether the drop is to be printed in one of the first print positions; and (4) whether the drop is to be printed in one of the second print positions; and charging the drops to the determined charges.

7. The method of claim 6, further comprising:

providing a first look-up table of charge values for each pair of adjacent print positions, each of said first look-up tables including a plurality of charge values which correspond to the charge to be applied to a print drop as a function of (1) the charges of each of a predetermined history drops that precede the drop in the stream and (2) the charges of each of a predetermined number of future drops that follow the print drop in the stream;

providing a second look-up table of charge values for each pair of adjacent positions, each of said second look-up tables including a plurality of charge values which correspond to the charge to be applied to a print drop as a function of (1) the charges of each of a predetermined history drops that precede the drop in the stream and (2) the charges of each of a predetermined number of future drops that follow the print drop in the stream; and wherein the determining step further comprises determining whether a drop is to be printed in one of the first and second print positions and (1) retrieving a charge value from the first look-up table if the print drop is to be printed in the first print position and (2) retrieving a charge value from the second look-up table if the print is to be printed in the second print drop position.

8. A method for operating a continuous ink jet printer of the type which projects a stream of evenly spaced ink drops toward a substrate and controls placement of the ink drops on the substrate by selectively charging the individual ink drops and passing the charged ink drops through an electric field to control placement of said charged ink drops on a substrate, the method comprising:

generating a raster pattern comprising at least one column of N positions therein, of which only n of said positions are allowed to be used as active print positions in the print line, where N>n;

dividing at least some of the N virtual print positions into pairs of adjacent print positions, each pair of adjacent print positions having a first print position and a second print position;

providing first and second charge look-up tables for each pair of adjacent print positions, each of said charge look-up tables including a plurality of charge values corresponding to the charge to be applied to a print drop as a function of (1) the charges of a predetermined number of history drops that precede the drop in the stream and (2) the charges of a predetermined number of future drops that follow the print drop in the stream; and for each drop in the ink drop stream, (1) determining whether the drop is to be printed in one of the upper and the lower print positions, (2) retrieving a charge value from one of the first look-up tables if the print drop is to be printed in a first print position, (3) retrieving a charge value from one of the second look-up tables if the print drop is to be printed in a second print position, and (4) charging the drop to the determined charge.

9. A stroke-based method for printing multiple lines of print in a single stroke using a continuous ink jet printer of the type which projects a stream of evenly spaced ink drops toward a substrate and controls placement of the ink drops on the substrate by selectively charging the individual ink drops and passing the charged ink drops through an electric field to control placement of said charged ink drops on a substrate, wherein each print line in a stroke includes N virtual print positions therein of which only n of said positions are allowed to be used as active print positions in the print line, where N>n, the method comprising:

dividing at least some of the N virtual print positions into pairs of adjacent print positions, each pair of adjacent print positions having a first print position and a second print position;

determining a charge to be applied to a drop as a function of (1) the charges of each of a predetermined number of history drops that precede the drop in the stream, (2) the charges of each of a predetermined number of future drops that follow the print drop in the stream, (3) whether the drop is to be printed in one of the first print positions, and (4) whether the drop is to be printed in one of the second print positions; and charging the drop to the determined charge.

10. The method of claim 9, wherein the determining and charging steps are repeated for each drop which is printed in the stroke.

11. The method of claim 9, wherein the combined number of history drops and future drops in the determining step is less than the number of virtual positions in the stroke.

12. The method of claim 9, wherein the combined number of history drops and future drops in the determining step is less than the number of virtual positions in each line of print in the stroke.

13. The method of claim 9, further comprising:

providing a first look-up table of charge values, each charge value corresponding to the charge to be applied to a print drop based on the charges of a predetermined number of history and future drops;

providing a second look-up table of charge values, each charge value corresponding to the charge to be applied to a print drop based on the charges of a predetermined number of history and future drops; and wherein the determining step further comprises retrieving a charge value for a drop from the first look-up table if the drop is to be printed in one of the first print positions or from the second look-up table if the drop is to be printed in one of the second print positions.

14. The method of claim 9, wherein each stroke includes at least two lines of print.

15. The method of claim 9, wherein successive drops in the stroke are printed from alternating print lines in the stroke.

16. The method of claim 9, wherein each stroke includes three lines of print, and wherein one of the lines of print comprises guard drops which are not charged sufficiently to be deflected onto the substrate.

17. The method of claim 9, wherein the first and second positions correspond to lower and upper positions, respectively.

18. The method of claim 9, wherein the history and future drops considered in the determining step are from the same stroke as the print drop.

19. The method of claim 9, wherein the charge to be applied to a drop is determined as a function of the charges of each of three history drops and each of two future drops.

20. A stroke-based method for printing multiple lines of print in a single stroke using a continuous ink jet printer of the type which projects a stream of evenly spaced ink drops toward a substrate and controls placement of the ink drops on the substrate by selectively charging the individual ink drops and passing the charged ink drops through an electric field to control placement of said charged ink drops on a substrate, the method comprising:

providing each line of print in the stroke with N virtual print positions of which only n of said positions are allowed to be used as active print positions in the print line, where N>n;

dividing at least some of the N virtual print positions into pairs of adjacent print positions, each pair of adjacent print positions having a first print position and a second print position;

for each drop printed in a stroke, determining a charge to be applied to the drop as a function of (1) the charges of each of a predetermined number of history drops that precede the drop in the stream, (2) the charges of each of a predetermined number of future drops that follow the print drop in the stream, (3) whether the drop is to be printed in one of the first print positions, and (4) whether the drop is to be printed in one of the second print positions, and wherein the combined number of history drops and future drops considered in determining the charge to be applied to a drop is less than the number of virtual positions N in each line of print; and charging the drops to the determined charges.

21. A stroke-based method for printing two lines of print in a single stroke, wherein said printer projects drops towards a substrate moving in a first direction and deflects each drop in a second direction by applying a charge to said drop and passing said drop through an electric field, comprising:

a. providing each print line in the stroke with N virtual print positions of which only n of said positions are allowed to be used as active print positions in the print line, where N>n;

b. dividing at least some of the N virtual print positions into pairs of adjacent print positions, each pair of adjacent print positions having a first print position and a second print position;

c. determining the charge to be applied to a drop to be printed to be printed in the first line of print as a function of (1) the charges of a predetermined number of history drops that precede the drop in the stroke, (2) the charges of a predetermined number of future drops that follow the print drop in the stroke, and (3) whether the drop is to be printed in one of the first print positions or one of the second print positions;

d. charging the drop to the charge determined in step c;

e. determining the charge to be applied to a drop to be printed in the second line of print as a function of (1) the charges of a predetermined history drops that precede the drop in the stroke, (2) the charges of a predetermined number of future drops that follow the print drop in the stroke, and (3) whether the drop is to be printed in one of the first print positions or one of the second print positions;

f. charging the drop to the charge determined in step e; and g. repeating steps c through f until all of the drops in the stroke are printed.

22. A stroke-based method for printing multiple lines of print in a single stroke using a continuous ink jet printer of the type which projects a stream of evenly spaced ink drops toward a substrate and controls placement of the ink drops on the substrate by selectively charging the individual ink drops and passing the charged ink drops through an electric field to control placement of said charged ink drops on a substrate, the method comprising:

providing each line of print in the stroke with N virtual print positions of which only n of said positions are allowed to be used as active print positions in the print line, where N>n;

for each line of print, dividing at least some of the N virtual print positions into pairs of adjacent positions, each pair of adjacent positions having a first print position and a second print position;

for each pair of adjacent positions, providing a first look-up table of charge values which correspond to the charge to be applied to a print drop in the first print position as a function of (1) the charges of each of a predetermined number of history drops that precede the drop in the stream and (2) the charges of each of a predetermined number of future drops that follow the print drop in the stream;

for each pair of adjacent positions, providing a second look-up table of charge values which correspond to the charge to be applied to a print drop in the first print position as a function of (1) the charges of each of a predetermined history drops that precede the drop in the stream and (2) the charges of each of a predetermined number of future drops that follow the print drop in the stream; for each drop to be printed in the stroke, determining the charge to be applied to the drop by retrieving one of (1) a charge value from one of the first look-up tables if the print drop is to be printed in one of the first print positions and (2) a charge value from one of the second look-up tables if the drop is to be printed in one of the second print drop positions; and charging the drops to the determined charges.

23. A method for printing using a continuous ink jet printer of the type which projects a stream of evenly spaced ink drops toward a substrate and controls placement of the ink drops on the substrate by selectively charging the individual ink drops and passing the charged ink drops through an electric field to control placement of said charged ink drops on a substrate, the method comprising:

generating a raster pattern comprising at least one column having a plurality of virtual print positions therein;

dividing at least some of the virtual print positions into pairs of adjacent print positions, each pair of adjacent print positions having a first print position and a second print position, wherein only one print position per pair is allowed to be an active print position in the column;

for each drop printed in a column, determining a charge to be applied to a drop as a function of (1) the charges of each of a predetermined number of history drops that precede the drop in the stream, (2) the charges of each of a predetermined number of future drops that follow the print drop in the stream, (3) whether the drop is to be printed in one of the first print positions; and (4) whether the drop is to be printed in one of the second print positions; and charging the drops to the determined charges.

24. A continuous ink jet printer of the type which projects a stream of evenly spaced ink drops toward a substrate and controls placement of the ink drops on the substrate by selectively charging the individual ink drops and passing the charged ink drops through an electric field to control placement of said charged ink drops on a substrate, the printer comprising:

means for generating a raster pattern comprising at least one column having a plurality of virtual print positions therein, at least some of said virtual print positions being divided into pairs of adjacent print positions, each pair of adjacent print positions having a first print position and a second print position, wherein only one print position per pair is allowed to be an active print position in the column;

means determining a charge to be applied to the drops in the stream a function of (1) the charges of each of a predetermined number of history drops that precede the drop in the stream, (2) the charges of each of a predetermined number of future drops that follow the print drop in the stream, (3) whether the drop is to be printed in one of the first print positions; and (4) whether the drop is to be printed in one of the second print positions; and means for charging the drops to the determined charges.

25. An continuous ink jet printer apparatus of the type which projects a stream of evenly spaced ink drops toward a substrate and controls placement of the ink drops on the substrate by selectively charging the individual ink drops and passing the charged ink drops through an electric field to control placement of said charged ink drops on a substrate, the printer being arranged to print multiple lines of print in a single stroke, each line of print in the stroke having N virtual print positions of which at least some of the N virtual print positions being divided into pairs of adjacent positions, each pair of adjacent positions having a first print position and a second print position, where only one print position in any given pair of print positions is allowed to be an active print position during any given stroke, the apparatus comprising:

a plurality of first look-up tables, each of which is associated with a different one of said pairs of adjacent print positions, each of said first look-up tables containing a plurality of charge values which correspond to the charge to be applied to a print drop in one of the first print positions as a function of (1) the charges of each of a predetermined history drops that precede the drop in the stream and (2) the charges of each of a predetermined number of future drops that follow the print drop in the stream;

a plurality of second look-up tables, each of which is associated with a different one of said pairs of adjacent print positions, each of said second look-up tables containing a plurality of charge values which correspond to the charge to be applied to a print drop in one of the second print positions as a function of (1) the charges of each of a predetermined number of history drops that precede the drop in the stream and (2) the charges of each of a predetermined number of future drops that follow the print drop in the stream;

a controller adapted to determine the charge to be applied to drops in the stream and produce a control signal responsive thereto, the controller determining said charge for a drop by (1) retrieving a charge value from one of the first look-up tables if the drop is to be printed in one of the first print positions, or (2) retrieving a charge value from one of the second look-up tables if the drop is to be printed in one of the second print drop positions; and a charging tunnel adapted to receive the control signal from the controller and charge the drops to the determined charges in response thereto.

26. A method for printing using a continuous ink jet printer of the type which projects a stream ink drops toward a substrate and controls placement of the ink drops on the substrate by selectively charging the individual ink drops and passing the charged ink drops through an electric field to control placement of said charged ink drops on a substrate, the method comprising:

dividing at least some virtual print positions into pairs of adjacent print positions, each pair of adjacent print positions having a first print position and a second print position; and determining a charge to be applied to a drop as a function of (1) the charges of each of a predetermined number of history drops that precede the drop in the stream, (2) the charges of each of a predetermined number of future drops that follow the print drop in the stream, (3) whether the drop is to be printed in one of the first positions, and (4) whether the drop is to be printed in one of the second positions.

27. A method for printing using a continuous ink jet printer of the type which projects a stream ink drops toward a substrate and controls placement of the ink drops on the substrate by selectively charging the individual ink drops and passing the charged ink drops through an electric field to control placement of said charged ink drops on a substrate, the method comprising:

dividing at least some virtual print positions into pairs of adjacent print positions, each pair of adjacent print positions having a first print position and a second print position; and determining a charge to be applied to a print drop as a function of the charges of each of a predetermined number of future drops that follow the print drop in the stream, whether the drop is to be printed in one of the first positions, and whether the drop is to be printed in one of the second positions.

* * * * *